US006230995B1

(12) United States Patent
Niemi et al.

(10) Patent No.: US 6,230,995 B1
(45) Date of Patent: May 15, 2001

(54) MICRONIZING DEVICE AND METHOD FOR MICRONIZING SOLID PARTICLES

(75) Inventors: Jouko Niemi, Pirkkala; Veikko Ilmasti, Helsinki, both of (FI); Hannu L. Suominen, Golden, CO (US)

(73) Assignees: Micropulva Ltd Oy, Pirkkala; BCDE Group Waste Management Ltd Oy, Helsinki, both of (FI)

( * ) Notice: Subject to any disclaimer, the term of this patent is extended or adjusted under 35 U.S.C. 154(b) by 0 days.

(21) Appl. No.: 09/422,334

(22) Filed: Oct. 21, 1999

(51) Int. Cl.[7] ..... B02C 19/06

(52) U.S. Cl. ..... 241/5; 241/24.14; 241/29; 241/39; 241/152.2; 241/155.1

(58) Field of Search ..... 241/188.2, 188.1, 241/5, 39, 40, 29, 152.2, DIG. 31, 24.14, 24.17

(56) References Cited

U.S. PATENT DOCUMENTS 2,839,253 * 6/1958 Yellott ..... 241/39

* cited by examiner

*Primary Examiner*—Mark Rosenbaum

(74) *Attorney, Agent, or Firm*—Connolly Bove Lodge & Hutz

(57) ABSTRACT

The invention concerns a micronizing device comprising a grinding housing with an outlet opening at one end, two coaxially positioned rotatably driven hollow axles entering the grinding house through two opposite side walls thereof, each of said axles having an inner end provided with a conically enlarging disc defining a grinding chamber, a circumferential outlet gap being formed between said discs, each disc being provided with at least one concentrically positioned ring of axially directed taps or wings near the circumference of the disc, the rings having different diameters, so that said discs can be driven to rotate in opposite directions, two acceleration nozzles are brought into the grinding chamber through the hollow axles, said nozzles being directed towards a common point in the grinding chamber away from a center point of said grinding chamber. The invention concerns also a method using said device.

9 Claims, 2 Drawing Sheets

MICRONIZING DEVICE AND METHOD FOR MICRONIZING SOLID PARTICLES

BACKGROUND OF THE INVENTION

This invention refers to a micronizing device and a method for micronizing solid particles fluidized in a pressurized power gas.

All industrial fields from medical industry to mine and building material industry use as raw materials a continuously increasing amount of different types of finely ground or micronized powder like dry products. The micronizing/fine-grinding of these products is nowadays generally carried out in jet mills, in which highly pressurized air or overheated water vapor is generally used as grinding energy. Depending on the final product and the fineness thereof tho energy consumption of these grinding and classifying processes is about 100 to 3000 kWh/ton.

An effective and relatively economical micronizing method is a technique operating according to the opposed jet mill principle. The opposed jet mill technique was developed during the 1980:ies and the 1990:ies substantially by the Finnish company Oy Finnpulva Ab, by means of which technique the energy economy and the grinding effectiveness of the fine grinding have been improved considerably. However, a wider utilization and application of the developed opposed jet mill technique has been considerably disturbed by the lack of effective auxiliary techniques applicable in connection with that technique and/or their low efficiency and high energy costs.

In fine-grinding/micronizing a high-energy power gas, most often pressurized air, is used as grinding energy. The micronizing devices will need industrial compressor effects ranging from 100 kw to 1000 kW depending upon application.

A drawback of previously known minronizing devices and methods is the considerably increasing energy consumption if the counter jet mill is adjusted to concentrate the grinding to eliminate particles having a particle size over 10 $\mu$m. Further the pressure of the power gas has to be considerably high because an elevated pressure must be maintained in the jet mill in order to force the ground solid-gas suspension to a classifier and further treatment steps.

It is, therefore, an object of the present invention to eliminate the above drawbacks by providing a new and improved micronizing device.

It is another object of the present invention to provide a new and improved method for micronizing solid particles fluidized in a pressurized power gas having no one of the above drawbacks.

SUMMARY OF THE INVENTION

In accordance with the present invention there is provided a micronizing device comprising a grinding housing with an outlet opening at one end, two coaxial positioned rotatable driven hollow axles entering the grinding house through two opposite side walls thereof, each of said axles having an inner end provided with a conical enlarging disc defining a grinding chamber, a circumferential outlet gap being formed between said discs, each disc being provided with at least one concentrically positioned ring of axially directed taps and/or wings near the circumference of the disc, the rings having different diameters, so that the discs can be driven to rotate in opposite directions. Two acceleration nozzles are brought into said grinding chamber through said hollow axles, said nozzles being directed towards a common point in the grinding chamber away from a center point of said grinding chamber.

By means of such a micronizing device the pressure of the fluidized gas-solid suspension can be lowered without affecting the grinding result because the pressure in the grinding chamber is lowered due to a fan effect of the appositely rotating wings and taps at the discs. Further said taps and wings can be adjusted to mechanically grind possible coarser particles, having a particle size over 10 $\mu$m, passing the gap between the two discs, with considerably smaller energy consumption as required in a conventional opposed jet mill technique. In a micronizing device according to the present invention the gas volume to be circulated is considerably smaller than in a conventional opposed jet mill resulting in still improved energy economy.

In accordance with the invention there is also provided a method for micronizing solid particles fluidized in a pressurized power gas comprising the steps of accelerating a fluidized solid-gas suspension through two opposedly directed acceleration nozzles into a grinding chamber, wherein the solids are ground on colliding against one another between two opposed conical discs rotating in different directions, during escaping from the grinding chamber through a circumferential gap between the discs the thus ground gas/solid suspension is mechanically further ground by means of taps and/or wings extending axially from a circumferential inner surface of both oppositely rotating discs, arid such a further ground solid-gas suspension will then leave a grinding house surrounding said discs through an outlet opening.

Further features of the invention will appear from the attached dependent claims.

DESCRIPTION OF A PREFERRED EMBODIMENT

Figure 1:
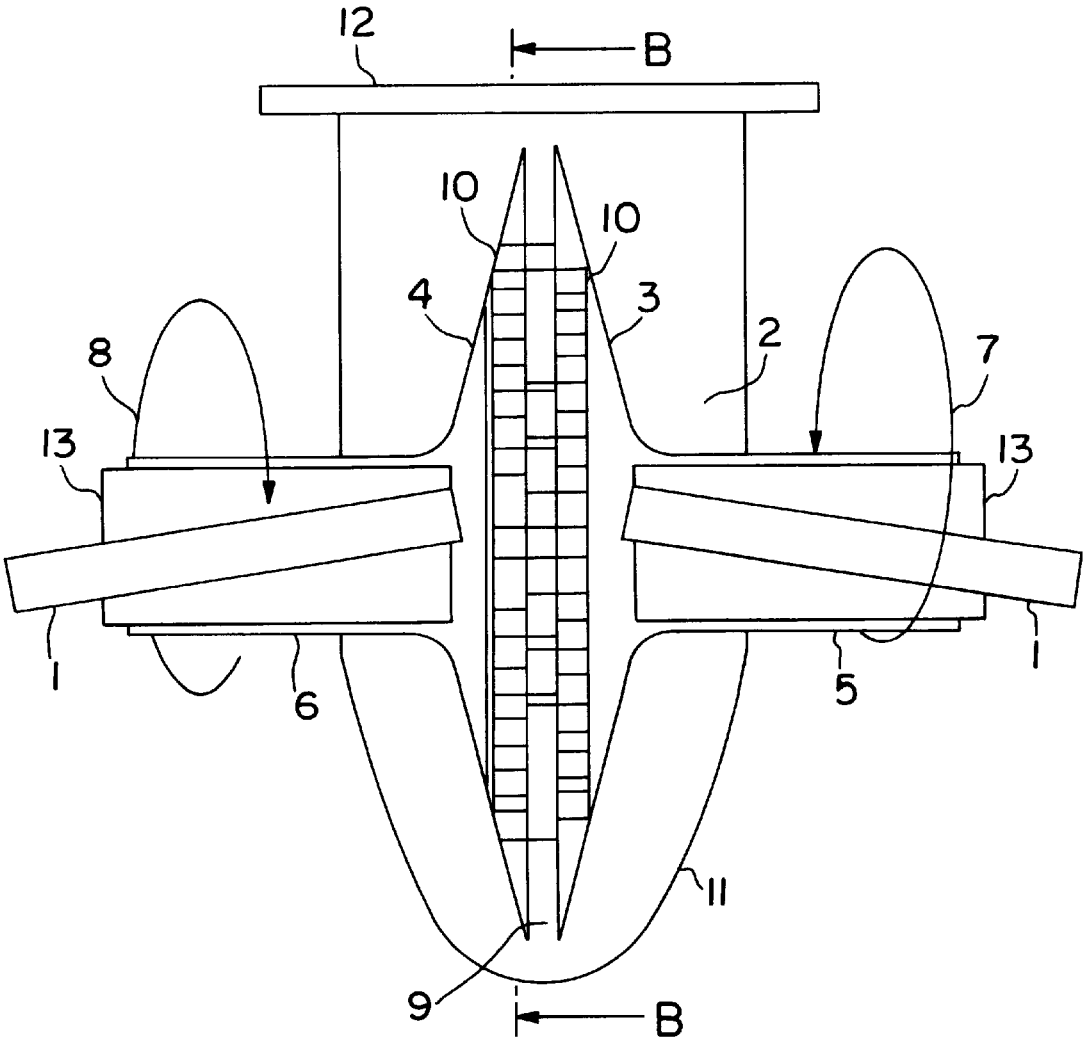
FIG. 1 is a schematic vertical section A—A a micronizing device according to the invention.
Figure 2:
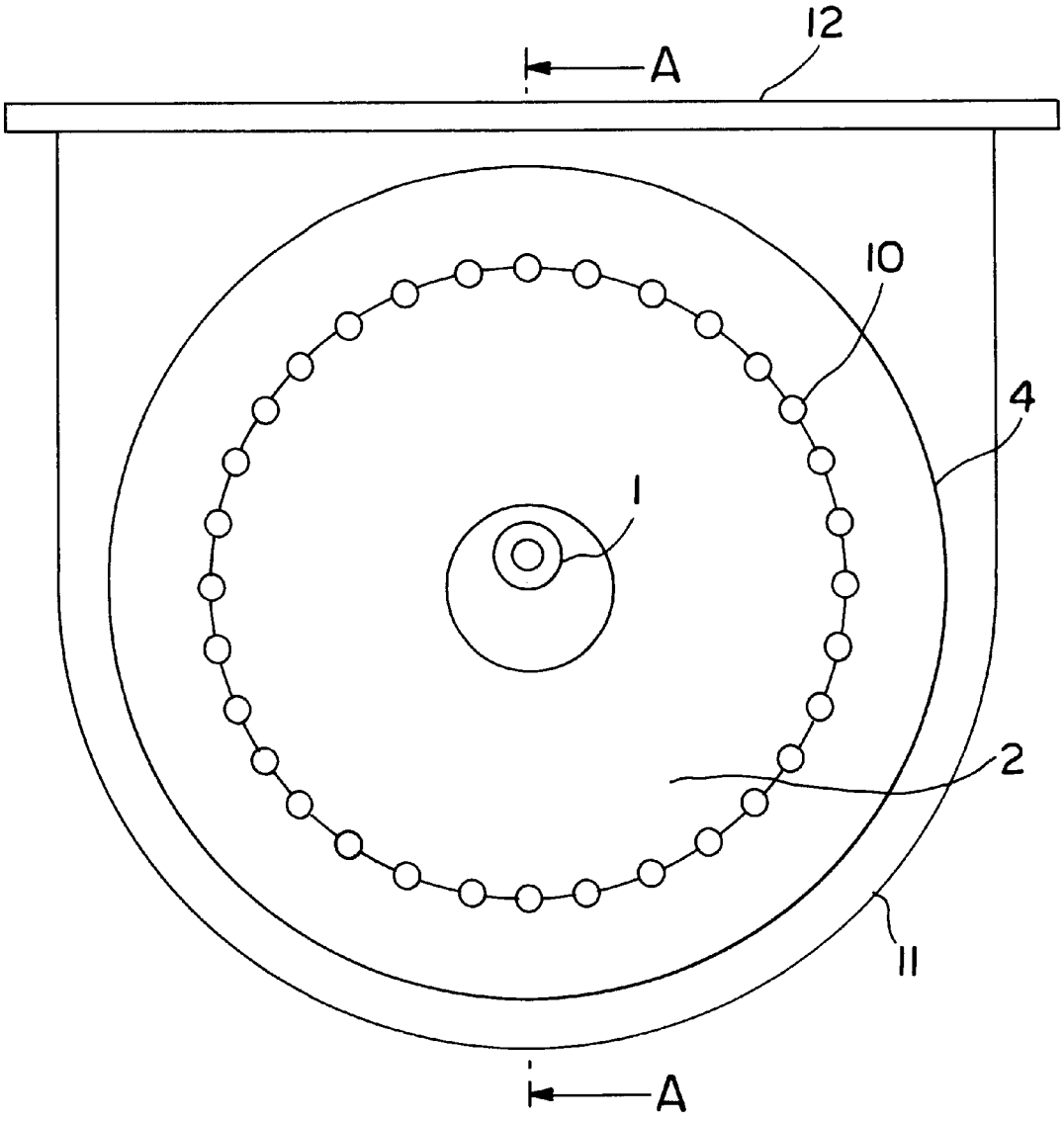
FIG. 2 is a vertical section B—B through the micronizing device in FIG. 1.

The material to be ground/micronized is fluidized with a pressurized power gas, such as air and a fluidized solid-gas suspension if accelerated through two acceleration opposedly directed accelerating nozzles 1 into a grinding chamber 2, defined by a pair of opposed conical discs 3 and 4. The acceleration nozzles 1 are directed toward a common point in the grinding chamber 2 away from the center point of said grinding chamber. This will prevent solids accelerated and flowing out of one acceleration nozzle 1 to enter the opposed acceleration nozzle 1, which would cause considerable abrasive defects in the latter. The solids are ground on colliding against one another. Said conical discs 3 and 4 are mounted on two coaxial hollow axles 5 and 6 driven to rotate in opposite directions as indicated by arrow 7 and 8. The conical discs 3 and 4 are positioned at a distance from each other forming a circumferential outlet gap 9 between them. Each disc 3 and 4 is provided with at least one concentrically positioned ring of axially directed taps 10 or wings near the circumference of the disc 3 and 4 and extending across said outlet gap 9. The diameter of each ring of taps 10 or wings is different enabling the conical discs 3 and 4 to rotate in opposite directions. The discs 3 and 4 are surrounded by a grinding house 11 provided with an outlet opening 12 at one end. The hollow axles 5, 6 of the conical discs 3, 4 enters the grinding house 11 through two opposite sidewalls of said grinding house 11. The gas/solid suspension ground in the grinding chamber 2 will escape through said circumferential outlet gap 9. On passing through the gap 9 the ground gas/solid suspension will be mechanically further ground by means of said axially directed taps 10 or wings rotating together with the conical discs 3 and 4. Simultaneously said taps and wings will act as a fan decreasing the pressure in the grinding chamber and forcing the further ground gas/solid suspension out of the grinding house 11 to further treatment steps.

The reduced pressure in the grinding chamber 2 will positively increase the grinding result on maintaining the initial pressure of the power gas. For instance if the pressure in the grinding chamber is lowered by 0.5 bar the grinding efficiency will increase by more than 10%.

In order to protect the discs 3 and 4 defining the grinding chamber 2 against abrasion, each disc 3 and 4 is provided with a reinforcing annular inner surface covering a region which will face the opposed acceleration nozzle 1 during the rotation of said discs 3, 4.

The effectiveness of the micronizing device can further be adjusted by changing the number of concentric rings of axially extending taps 10 or wings at both discs 3, 4 as well as by varying the rate of rotation of said discs. In order to receive a possibly good fan effect in the micronizing device it is preferred to have an outer-most ring of axially extending wings at both discs 3, 4.

According to a preferred embodiment a solid static cylindrical metal piece 13 is inserted In the hollow axles 5, 6, through which metal piece the acceleration nozzle 1 is extended.

A most optimal grinding result will be received if the pressure of the power gas and the solid content in the solid/gas suspension are adjusted to receive optimal micronization of a fine fraction and the shape and number of the taps 10 or wings as well as the rate of rotation of the discs 3, 4 are adjusted to regulate optimal mechanical grinding of any coarse particles passing through the circumferential gap 9 between said discs 3, 4.

Due to these effects a better and controllable grinding result will be achieved by less grinding energy than in conventional grinding.

The micronizing device according to the present invention can be used for instance in micronizing pyrolized carbon from old car tires, from which carbon steel has been removed by using a magnetic separator. Further the micronizing device can be used in the medical, and in the food industry as well as in the paint and building industry.

What is claimed is:

1. Micronizing device comprising a grinding housing with an outlet opening at one end, two coaxial positioned ratably driven hollow axles entering the grinding house through two opposite side walls thereof, each of said axles having an inner end provided with a conical enlarging disc defining a grinding chamber, a circumferential outlet gap being formed between said discs, each disc being provided with at least one concentrically positioned ring of axially directed taps or wings near the circumference of the disc, the rings having different diameters, so that said discs can be driven to rotate in different speed or in opposite directions, two acceleration nozzles extending into the grinding chamber through the hollow axles, said nozzles being directed towards a common point in the grinding chamber away from a center point of said grinding chamber.

2. Micronizing device according to claim 1, wherein the discs are provided with a reinforcing annular inner surface covering a region facing the opposed acceleration nozzle during the rotation of said disc.

3. Micronizing device according to claim 1, wherein the acceleration nozzles are fed with solid particles fluidized with pressurized power gas.

4. Micronizing device according to claim 1 wherein in each hollow axle there is a solid static cylindrical piece through which the acceleration nozzle is extended.

5. Method for micronizing solid particles fluidized in a pressurized power gas comprising the steps of:

accelerating a fluidized solid-gas suspension through two opposedly directed acceleration nozzles into a grinding chamber;

grinding said solids by colliding them against one another in said grinding chamber between two opposed conical discs;

rotating said conical discs at different speeds or in different directions;

grinding said solids of the thus ground gas/solid suspension further by way of mechanical taps and/or wings extending axially from a circumferential inner surface of both opposed rotating discs while said gas/solid suspension is escaping from said grinding chamber through a circumferential gap between said discs; and expelling said further ground solid-gas suspension from a grinding house surrounding said discs through an outlet opening, wherein said conical discs are driven by coaxially positioned hollow axles, and said acceleration nozzles are directed toward a common point in said grinding chamber away from a center point of said grinding chamber.

6. Method according to claim 5 wherein the pressure of the power gas and the solid content in the solid-gas suspension are adjusted to receive optimal micronization of a fine fraction and a shape and number of taps as well as the rate of rotation of the discs are adjusted to regulate optimal mechanical grinding of any coarse particles passing through the gap between said discs.

7. Method according to claim 5 wherein the material to be micronized is pyrolized carbon from old car tires.

8. Method according to claim 7 wherein steel from the tire has been removed by magnetic separation from the pyrolized carbon.

9. Method according to claim 5 wherein the oppositely rotating discs provided with axial wings act as a fan evacuating gas and ground products from and lowering the pressure in the space between discs.

* * * * *